United States Patent [19]

Halcomb et al.

[11] 3,969,874

[45] July 20, 1976

[54] PACKAGING MACHINE

[76] Inventors: Walter C. Halcomb, 600 Galaxie; Naomi A. Eastman; Robert D. Eastman, both of 1004 Green; Harvey A. VanMeter, 809 E. Pearl, all of Harrisonville, Mo. 64701; Russell W. Chapman, Rte. 1, Lee's Summit, Mo. 64063

[22] Filed: Oct. 17, 1974

[21] Appl. No.: 515,621

[52] U.S. Cl. ..... 53/183; 53/385

[51] Int. Cl.[2] ..... B65B 9/08

[58] Field of Search ..... 53/29, 183, 385

[56] References Cited

UNITED STATES PATENTS

| | | | |
|---|---|---|---|
| 2,612,738 | 10/1952 | Salfisberg | 53/29 |
| 3,269,087 | 8/1966 | Cloud et al. | 53/385 X |
| 3,448,555 | 6/1969 | Shabram | 53/29 |
| 3,754,370 | 8/1973 | Hanson | 53/385 X |

*Primary Examiner*—Travis S. McGehee
*Attorney, Agent, or Firm*—Lowe, Kokjer, Kircher

[57] ABSTRACT

A machine for successively forming open topped bags from a continuous roll of tubular, gusseted packaging material and for sealing the tops of the bags after they have been filled with objects. A pivotal heat sealing member is driven into engagement with the packaging material to seal the top of one bag, effect a series of perforations below the seal, seal the bottom of the next succeeding bag, and sever the packaging material between the two seals. A cutting member mounted on the rear side of the machine is simultaneously pivoted to cut substantially through the front web and the two folded gussets of the packaging material to form a three-sided opening in the top of the second bag. A roller then advances the sealed bottom portion of the second bag into a support tray with the open top portion in a convenient position for receiving objects. A single motor drives the working components of the machine. The linkage of the motor to the roller includes a lost motion connection to assure that the sealing and cutting members are withdrawn from engagement with the packaging material prior its advancement.

9 Claims, 12 Drawing Figures

Fig. 1.
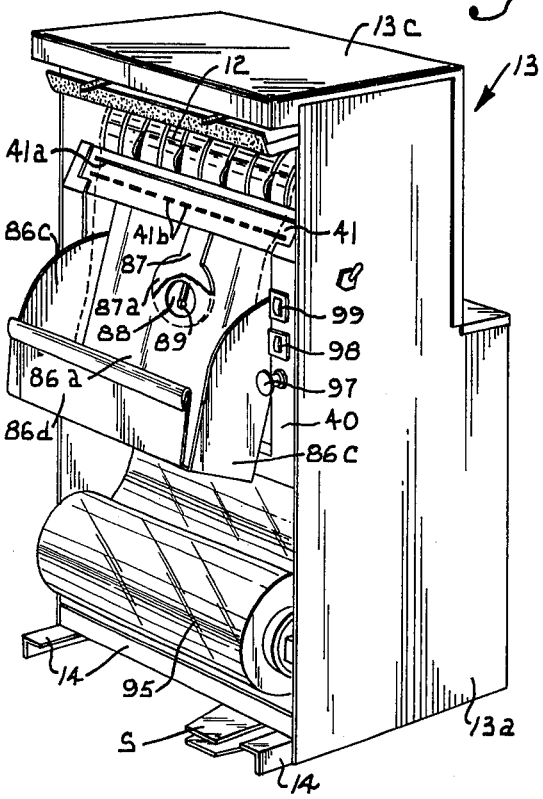
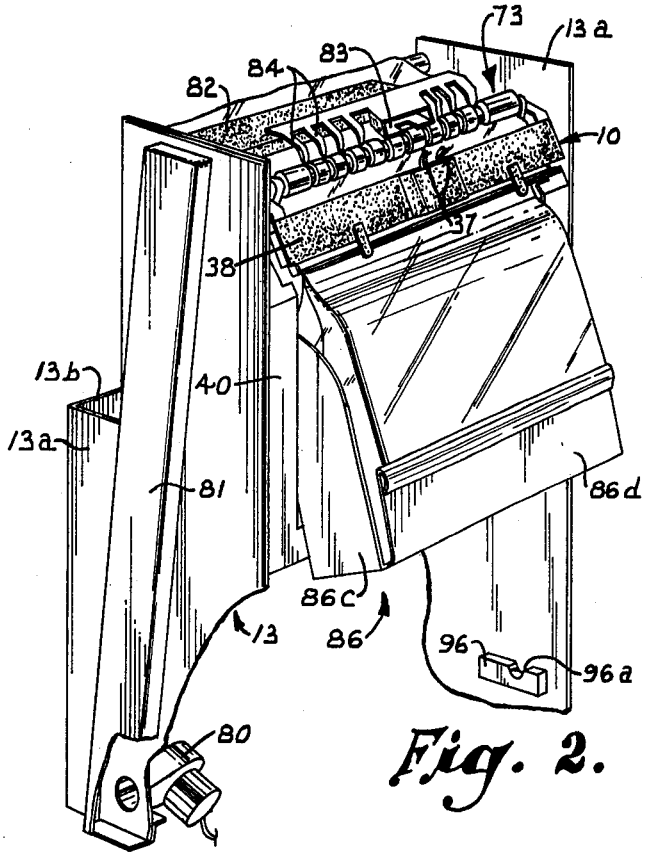
Fig. 2.
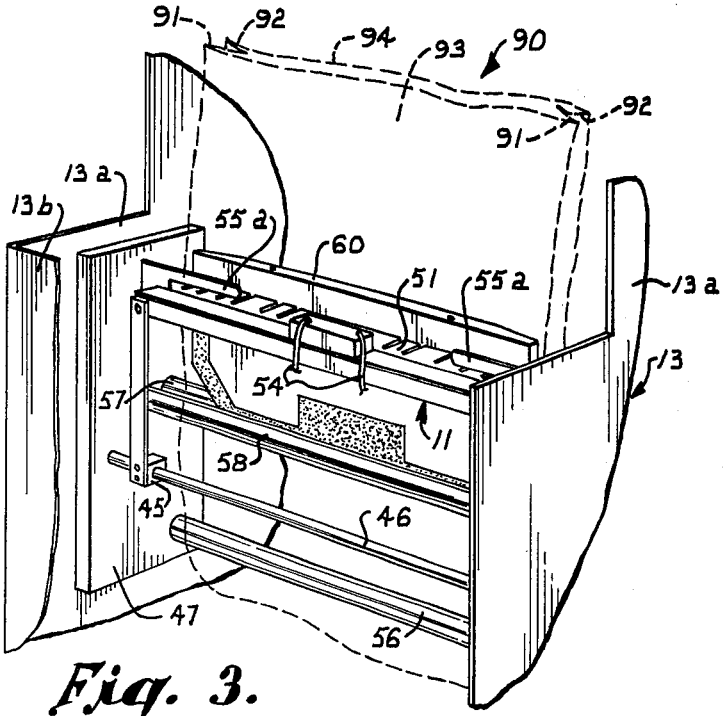
Fig. 3.
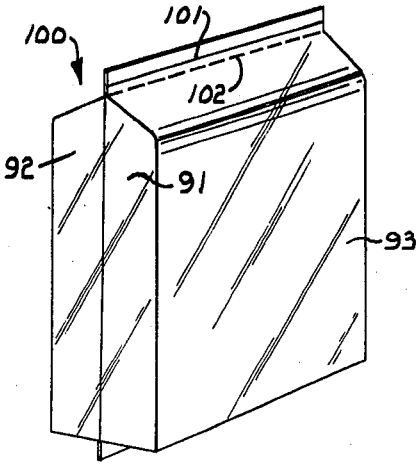
Fig. 4.

Fig 8.
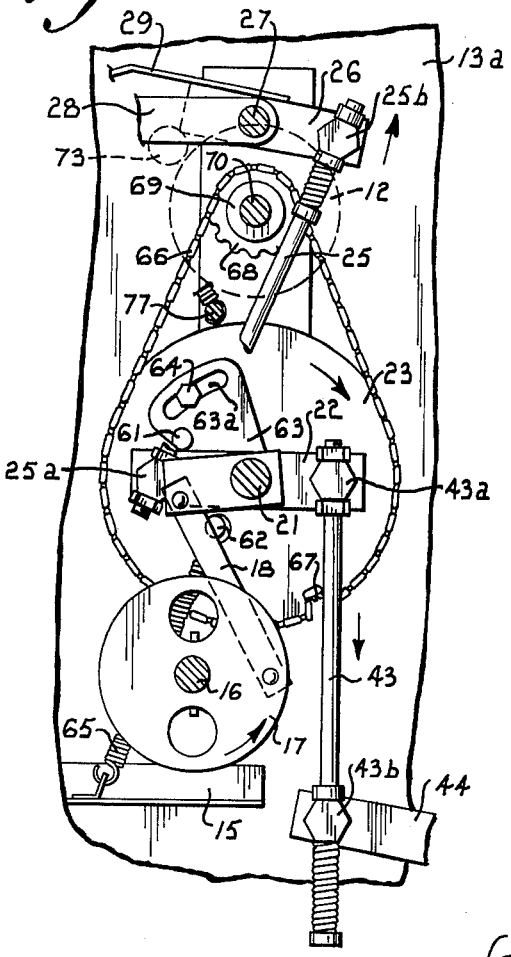
Fig. 9.
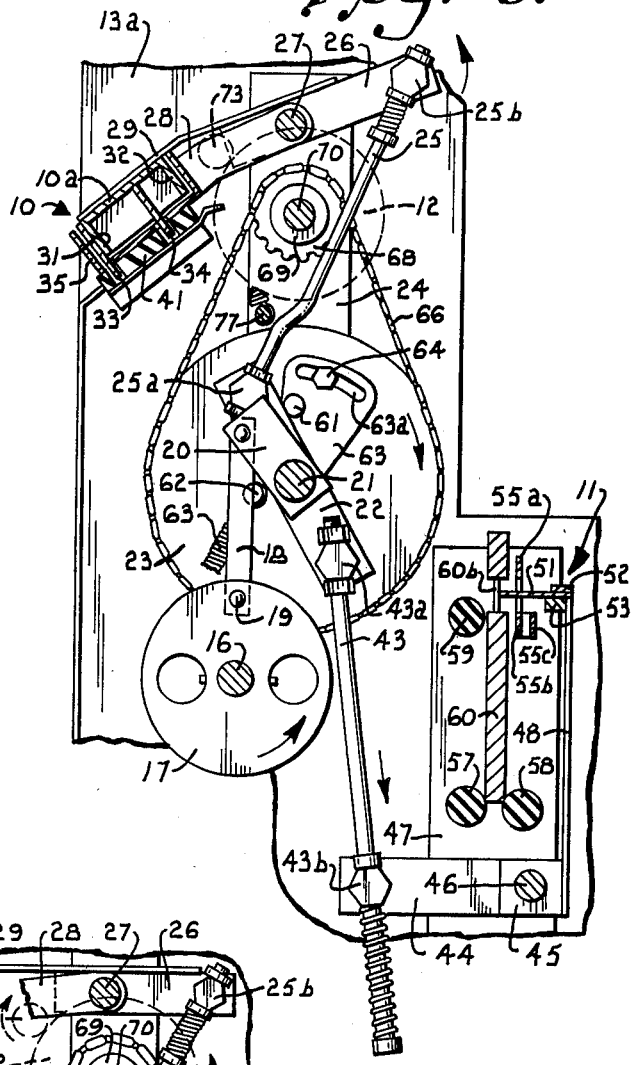
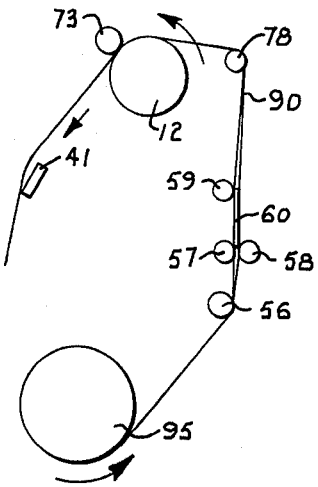
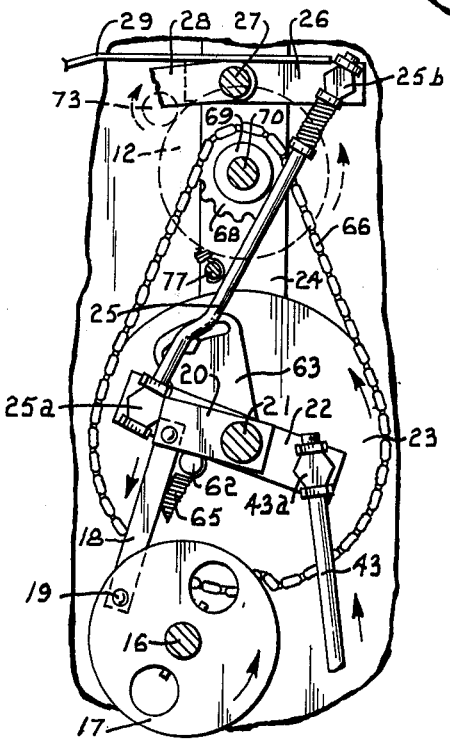
Fig. 10.
Fig. 12.

PACKAGING MACHINE

BACKGROUND AND SUMMARY OF THE INVENTION

This invention relates generally to a packaging machine for use in stores, such as supermarkets and the like, and more particularly to a machine that forms individual bags from a continuous roll of tubular packaging material and seals the tops of the bags after they have been filled with goods.

In large self-service retail stores, the ordinary practice is to package purchased goods in paper bags after the price has been tabulated at the check-out counter. The empty bags are usually folded into flat form for convenient storage, and the time required to manually unfold the bags in order to fill them with goods delays the packaging operation and contributes greatly to the bottlenecks that often build up at check-out counters. Since the filled paper bags are not sealed at the tip, they must be carefully filled and handled to prevent their overturning and the contents from spilling. Furthermore, paper bags are susceptible to tearing and frequently fail under the weight of heavy goods, particularly if a liquid container carried within a bag should leak. Also, the packaging of goods in paper bags has created security problems because of the ease with which stolen items can be deposited and concealed in the open bags.

The present invention overcomes all of these problems by providing a machine that automatically forms successive bags held open at the top by a blower. After a bag has been filled with objects, the top of the bag is sealed and the next succeeding bag is immediately formed and advanced into position for receiving additional goods. Consequently, the time lag between the filling of successive bags is minimal and the packaging operation can be carried on continuously. Moreover, since the bags are formed of a strudy synthetic material and are sealed at the top, security problems and the possibility of the bags tearing or the contents spilling is virtually eliminated.

An object of the invention is to provide a method and apparatus for successively forming sturdy bags with openings in their top portions for receiving objects, and for sealing the tops of the bags after they have been filled with objects.

In conjunction with the preceding object, it is an additional object of the invention to provide a method and apparatus for packaging goods in leakproof, transparent bags. The packaging material preferably used with the invention is characterized by strength to prevent the bags from tearing or leading, while the transparency of the bags permits packaging techniques to be monitored and deters shoplifting. Also, since the packaging material requires less storage area than paper bags, available space is more efficiently utilized.

Another object of the invention is to provide, in an apparatus of the character described, means for holding the top portion of the bag open as objects are being inserted thereinto.

Yet another object of the invention is to provide an apparatus of the character described wherein the top of one bag is sealed and the next succeeding bag is formed and immediately advanced into a convenient position for receiving goods.

Still another object of the invention is to provide an apparatus of the character described which effects a weakened perforation line if desired near the top seal to facilitate the opening of the filled bag. An optional perforating blade may be included to accomplish this feature.

A further object of the invention is to provide, in an apparatus of the character described, a single member operable to seal and perforate the top of one bag, while simultaneously sealing the bottom of the next succeeding bag and severing the packaging material between the two seals.

A still further object of the invention is to provide an apparatus of the character described in which a single motor drives all of the working components. This feature is achieved by providing a lost motion connection as part of the linkage between the motor and the advance means, assuring that the bag forming members are withdrawn from engagement with the packaging material prior to the advancement thereof.

Other and further objects of the invention, together with the features of novelty appurtenant thereto, will appear in the course of the following description.

DETAILED DESCRIPTION OF THE INVENTION

In the accompanying drawings, which form a part of the specification and are to be read in conjunction therewith, and in which like reference numerals are utilized to indicate like parts in the various views:

FIG. 1 is a front perspective view of a packaging machine constructed in accordance with a preferred embodiment of the invention;

FIG. 2 is a fragmentary perspective view taken from the front of the packaging machine, with the sealing member shown in the sealing position;

FIG. 3 is a fragmentary perspective view taken from the rear of the packaging machine, with the cutting member shown in the cutting position and flexible packaging material shown by broken lines;

FIG. 4 is a perspective view of an individual bag filled and sealed in accordance with the operation of the packaging machine;

FIG. 8 is a fragmentary, side elevational view similar to FIG. 7 showing the positions of various members when the motor has driven its output shaft through approximately one-fourth of a full revolution;

FIG. 9 is a fragmentary, side elevational view similar to FIG. 7 showing the positions of various members when the motor has driven its output shaft through approximately one-half of a revolution;

FIG. 10 is a fragmentary, side elevational view similar to FIG. 7 showing the positions of various members when the motor has driven its output shaft through approximately two-thirds of a revolution;

FIG. 12 is a schematic diagram showing the threading of the packaging material through the guide and drive rollers of the machine.

Figure 5:
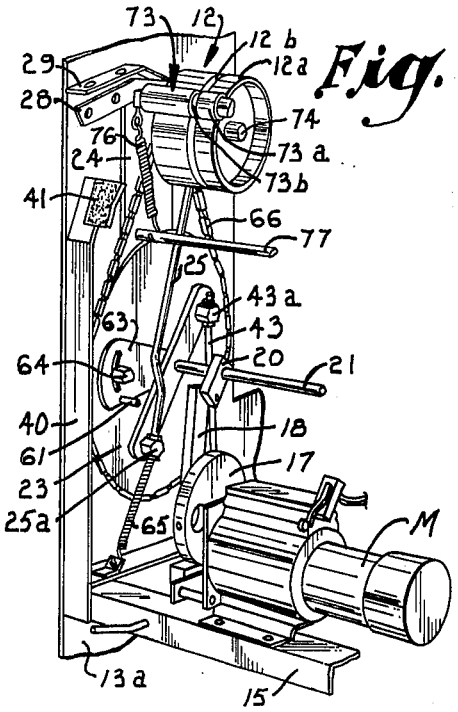
FIG. 5 is a fragmentary perspective view of the drive mechanism taken from the front of the packaging machine, with certain components broken away to better illustrate the details of construction.
Figure 6:
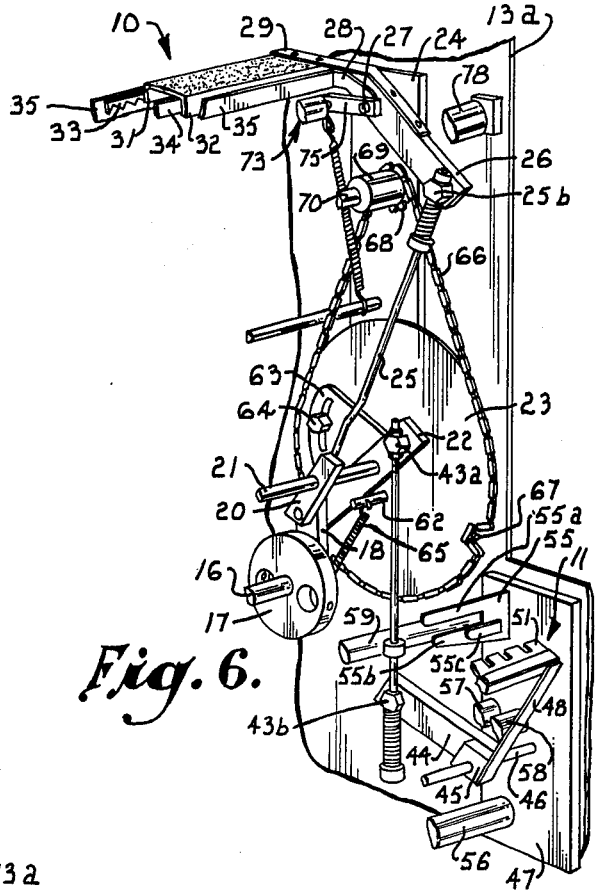
FIG. 6 is a fragmentary perspective view of the drive mechanism taken from the rear of the packaging machine, with certain components broken away to better illustrate the details of construction.

Referring now to the drawings in detail, the basic components of the packaging machine are seen as generally including a pivotal sealing member 10 for sealing, severing and perforating the packaging material, a pivotal cutting member 11 for forming openings in the tops of individual bag members, and an advance mechanism comprising a large cylindrical roller 12 for advancing the packaging material longitudinally, all of which are supported on a frame 13 and driven by a conventional gear motor M.

Frame 13 includes four connected angles 14 forming a rectangular base portion. Erectly supported from the base are opposite frame panels 13*a*. Interconnecting the lower side portions at the rear is a back panel 13*b*, while a hood member 13*c* interconnects the upper side portions at the rear and fits over the top of the frame.

A rectangular configuration of four angles 15 connected at an intermediate height to sides 13*a* forms a motor mount for supporting the gear motor M, which is securely bolted thereto near the left side of the frame. Motor M is operated by a pedal switch S (FIG. 1), the depression of which energizes the motor to rotatably drive an output shaft 16. The output shaft 16 in turn rotatably drives a small wheel 17, being centrally connected thereto at its left end. Eccentrically pinned to wheel 17 is a crank mechanism comprising a pair of levers 18 and 20. As seen in FIGS. 7–10, the lower end of lever 18 is pivotally joined to the left of back side of wheel 17 at a location below the wheel's axis of rotation, as at 19. Pivotally attached to the upper end of lever 18 is one end of the short lever 20, the other end of which rigidly connects to a rotatable shaft 21. A cutoff switch S′ (FIG. 7) is mounted on one of the angles 15 below wheel 17 at the left or back side thereof. switch S′ is upwardly biased to the "on" position wherein motor M may be energized by the depression of pedal switch S, while downward depression of switch S′ by the lower end of lever 18 deenergizes motor M.

The rotatable shaft 21 extends across the width of the frame and rigidly through the centers of a pair of levers 22, one of which is connected near each end of the shaft. A large wheel 23 is centrally supported on shaft 21 at a position between the left hand lever 22 and the adjacent frame side by means of a bearing (not shown). A pair of reinforcing plate members 24, one of which is secured to the inward surface of the upper portion of each side 13*a*, are appropriately journaled to receive the opposite ends of shaft 21.

The linkage of sealing member 10 and cutting member 11 to lever 22 will be described in detail for only the left side of the frame (as viewed from the front), it being understood that a second lever 22 is connected to shaft 21 near its right end, with linkage components similar to those now to be described connecting opposite ends of the second lever 22 to the sealing member and the cutting member respectively.

A bent rod 25 comprising a part of the linkage for sealing member 10 has its lower end threaded into a pivot coupling 25*b* carried on the forward end of lever 22 and its top end threaded into a second pivot coupling 25*b* mounted to the rearward end of another lever 26. A pivot connection 27 is utilized to pivotally support an intermediate portion of lever 26 on the reinforcing plate 24, and also to pivotally mount the rearward end of a bent bracket 28. A second bracket 29 extends above bracket 28 forwardly from connection with the top of lever 26. The linkage extending upwardly from the right hand lever 22 likewise terminates in a pair of similar brackets 28 and 29 located near the top of the right frame side 13*a*.

Carried between the forward ends of the opposite brackets 29 is the sealing member 10 which has its top plate 10*a* connected at each end to one of the brackets. Extending downwardly from top plate 10*a* along the entire length thereof are four thin, elongate blade-type elements, including the spaced sealing elements 31 and 32 located near each side of the plate. A toothed perforating blade 33 is located adjacently forwardly from the front sealer 31, while a severing blade 34 extends downwardly at a position between sealers 31 and 32. The provision of the perforating blade 33 is optional, and same may be omitted from the packaging machine if desired. The sealers 31 and 32, the perforator 33, and the severing blade 34 all include electrically resistive heating elements connected to a current source, as by the wires 37 (FIG. 2). Consequently, it is preferred that the sealing member be covered with heat insulating material 38.

An elongate safety housing 35 is connected at its ends to the opposite lower brackets 28. The housing comprises a channel having a series of lengthwise slots 36 in its lower face which are positioned to match with four blade elements of the sealing member. The relative positions of brackets 28 and 29 are such that safety housing substantially surrounds sealing member 10 and normally contains the four blade elements therein.

Extending upwardly from the front angle 15 are a pair of brackets 40, one connected to each side of the frame. A heat insulating pad member 41 is obliquely mounted between the tops of the opposite brackets 40 and provided with an elongate slot 41*a* for receiving the severing blade 34 and a plurality of short slits 41*b* for receiving the teeth of perforator 33. As has been mentioned, the four blade elements of sealing member 10 are ordinarily housed entirely within the safety housing 35. However, when member 10 is pivoted downwardly into contact with pad 41, the tips of sealers 31 and 32, the tip of perforator 33, and the tip of blade 34 are extended through the slots 36 in housing 35, as seen in FIG. 9.

Comprising a part of the linkage between the left hand lever 22 and cutting member 11 is a rod 43, the top end of which is threaded into a pivot coupling 43*a* carried on the lever 22 at the rearward end thereof. The lower end of rod 43 is threaded into another pivot coupling 43*b*, which is carried on the front end of a short lever 44. The other end of lever 44 is rigidly secured to a small block 45, and both the lever and block are pivotally supported by a shaft 46 extending across the width of frame 13. The opposite ends of shaft 46 are connected to a pair of reinforcing plate members 47, one of which is secured at an intermediate height to the inward surface of each side 13*a* near the rearward end thereof. Extending upwardly from block 45 is a bracket 48, while a matching bracket 48 comprising a part of the similar linkage from the rearward end of the right hand lever 22 extends upwardly from shaft 46 near its opposite end.

Cutting member 11, which is carried between the opposite brackets 48, comprises an elongate slotted blade 51 extending substantially across the width of the frame between a pair of blade retaining members 52 and 53 with one edge of the blade protruding forwardly therefrom. The members 52 and 53 have their ends secured to the top ends of the opposite brackets 48 and are tightly secured to the top and bottom surfaces of the blade 51 to securely retain the blade therebetween. The blade 51 includes electrically resistive heating elements connected to a current source by a pair of wires 54 (FIG. 3).

A guide member 55 extends inwardly from each of the opposite plates 47 near the tops thereof. Each guide member includes two vertically aligned, spaced fingers 55*a* and 55*b* and a third finger 55*c* which is spaced rearwardly from the lower finger 55*b*. As seen in FIG. 9, the forward pivoting of cutting member 11 carries blade 51 through the space between the vertically aligned fingers 55*a* and 55*b*.

Figure 7:
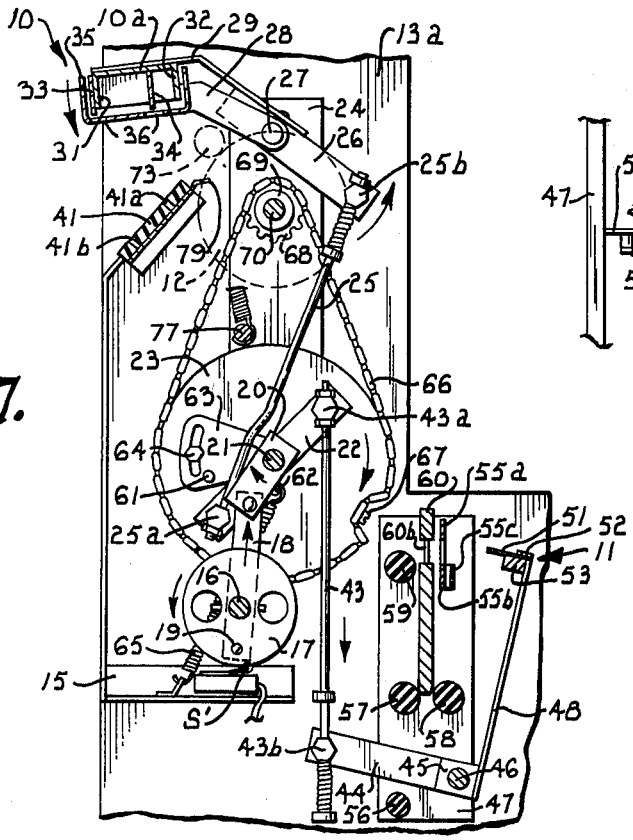
FIG. 7 is a fragmentary, side elevational view of the drive mechanism showing the positions of the various members thereof with the output shaft of the motor at the beginning of the sealing cycle.

Extending between the opposite plates 47 is a plurality of rotatable roller guides, including a lower roller 56, a pair of horizontally aligned rollers 57 and 58, and an upper roller 59 located near the guide member 55. A removable plug member 60 comprising a substantially rectangular plate is adapted to stand erectly upon the rollers 57 and 58. Plug 60 is tapered slightly at its lateral edges 60*a* and has a lengthwise recess or notch cut into each of its opposite faces to form a notched portion 60*b* of reduced thickness. As shown in FIGS. 7 and 9, notched portion 60*b* is disposed adjacently forwardly of the space between the fingers 55*a* and 55*b* when plug 60 is positioned on the rollers 57 and 58.

The cylindrical advance roller 12 is driven by the large wheel 23 which is mounted for rotation between the left hand lever 22 and the adjacent plate 24 and which includes a lost motion connection comprising an adjustable boss 61 and a fixed boss 62. Boss 61 extends inwardly from a substantially triangular plate 63 which is mounted to the inward face of wheel 23 angularly adjustable thereon by means of an arcuate slot 63*a* and a set screw 64 fitting through the slot. The fixed boss 62 extends inwardly from a direct connection to the inward base of wheel 23. The top end of a tension spring 65 is hooked in an aperture in boss 62, while the bottom of end of the spring is attached to one of the angles 15. As has been mentioned, the rotatable shaft 21 is not rigidly connected to wheel 23; therefore, the wheel is rotated only as a result of engagement between the pivotal lever 22 and one of the two bosses 62 or 63.

An endless chain 66 is secured to the periphery of wheel 23 by means of a screw 67 extending into the wheel at a notched peripheral portion thereof. The upper portion of chain 66 is trained around a sprocket 68 which is connected to and drives a sleeve 69. Sleeve 69 is centrally mounted near one end of a shaft 70 which has its ends supported by bearings (not shown) mounted to the plate members 24 located on the opposite sides of the frame. The connection between the sleeve 69 and shaft 70 is a conventional one way clutch connection, whereby the shaft is driven in response to the counterclockwise rotation of sleeve 69 (as viewed in FIGS. 7–10), while the sleeve does not drive shaft 70 in the clockwise direction.

Mounted centrally on shaft 70 and extending along the length thereof is the elongate cylindrical roller 12, which includes a plurality of individual roller elements 12*a* separated by thin slots 12*b*. A small idler roller 73 includes individual roller elements 73*a* rotatably mounted to a small rod 74 extending substantially across the width of frame 13 above and forwardly of shaft 70. The opposite ends of rod 74 are connected to the forward ends of a pair of short levers 75 mounted on opposite sides of the frame, the rearward ends of which are pivoted to the previously mentioned pivot connection 27. A pair of tension springs 76 are included to bias idler roller 73 toward engagement with the large roller 12. Each spring 76 has its top end hooked to one of the levers 75 and its lower end connected to a fixed rod 77 extending between the opposite plates 24. A rotatable roller guide 78 is mounted between opposite sides of the frame at a location above and behind the large roller 12. As best seen in FIGS. 7 and 9, the rear side of the pad member 41 includes a plurality of fingers 79 which ride in the slots 12*b* of the rotatable roller 12.

a motor driven fan 80 (FIG. 2) is mounted to the left side 13*a* of the frame near the bottom thereof. The fan outlet connects with a vertical conduit 81 secured to the outer surface of the frame side. Conduit 81 in turn connects with a horizontal conduit member 82 mounted between opposite sides of the frame near the top thereof. The conduit 82 has an outlet 83 located above the central portion of roller 73 and oriented to blow air downwardly past the roller. Conduit member 82 also carries a plurality of forwardly extending fingers 84, which ride in the slots 73*b* of the idler roller 73.

A removable support tray 86 is obliquely suspended from the fixed rod 77 to hang forwardly of the front of the frame. Tray 86 comprises a back panel 86*a*, a bottom portion 86*b*, the two curved sides 86*c*, and a short front panel 86*d*. The back panel 86*a* has a lever member 87 hingedly connected thereto. The lower end of member 87 includes a circular portion 87*a* which hangs downwardly over a small aperture 88 cut centrally through the back panel. A switch 89 controlling the operation of the fan motor is yieldably biased to normally extend slightly forwardly of back panel 86*a* through aperture 88, a position in which the fan motor is in the "on" condition. However, when substantial rearward pressure is exerted on member 87 to pivot it about its hinge connection, switch 89 is pushed rearwardly against its biasing force to deenergize the fan motor.

The packaging material used with the machine is generally designated by the numeral 90 and preferably comprises a sturdy, flexible, transparent synthetic. The arrangement of packaging material 90 is best shown by the broken lines of FIG. 3. The material comprises essentially a continuous, rectangular tube having four connected sides, two of which are folded inwardly in accordion fashion to form the two collapsed gussets. The inwardly folded portions 91 and 92 interconnect the opposite sides, which comprise a pair of continuous webs 93 and 94. The material thus arranged in a flat form may be wound around a hollow cylindrical core to form a continuous roll 95, as illustrated in FIG. 1. The lower portion of each frame side 13*a* is provided with a plate member 96 having an arcuate slot 96*a* therein. To rotatably mount roll 95, a shaft may be extended through its hollow core with the opposite ends of the shaft supported in the arcuate slots 96*a*.

One of the brackets 40 includes the main power switch 97 (FIG. 1), which is operable to connect fan 80, motor M, and the heating elements for sealing member 10 and cutting member 11 to an electric current source. A pair of indicator lights 98 and 99 are included on bracket 40, one indicating the on or off condition of main power switch 97 and the other connected to a thermostat mechanism (not shown) to indicate when the required temperatures of the sealing member and cutting member are reached.

Figure 11:
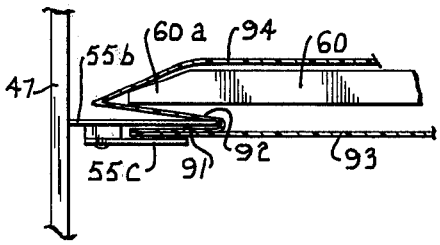
FIG. 11 is an enlarged, top plan view showing a portion of the plug member and one of the guide members which receive the packaging material as shown in FIG. 3.

To prepare the packaging machine for operation, the leading portion of the packaging material is pulled rearwardly from the rotatable roll 95 and drawn behind the roller guide 56 and between the adjacent roller guides 57 and 58 as best seen in FIG. 12. The material 90 is then threaded through the guide member 55 and the plug 60 in the manner shown in FIG. 11. Plug 60 is placed between the opposite webs and supported in its erect position upon rollers 57 and 58, while the folded portions 91 are threaded between the two spaced fingers 55*b* and 55*c* on each side of the frame. The wab 94 is thus insulated from cutting blade 51 by plug 60, while web 93 and both folded edges are accessible to the cutting member. The leading portion of packaging material 90 is then drawn tautly around the upper roller guide 78 and threaded between the two adjacent rollers 12 and 73. When the leading portion has been drawn over roller 12 and pulled downwardly past pad 41, the operation of the machine may begin.

As the main power switch 97 is turned on, sealers 31 and 32, perforator 33, severing blade 34, and cutting blade 51 begin to heat until indicator 99 signals that they have reached the required temperatures. FIGS. 7–10 illustrate the successive positions of the linkage components as the pedal switch S is depressed to energize motor M, which thereby effects a first power cycle driving output shaft 16 through a single counterclockwise revolution (as viewed in FIGS. 7–10). FIG. 7 shows the component positions previous to the energization of the motor.

The crank mechanism linking shaft 16 to shaft 21 causes lever 22 to immediately begin pivoting clockwise in response to the motor driving shaft 16 in the counterclockwise direction. This clockwise motion of lever 22 povots sealing member 10 rearwardly toward pad 41 and cutting member 11 forwardly toward plug 60. It is noted that since the distance between boss 61 and boss 62 is greater than the width of lever 22, the large wheel 23 does not begin its clockwise rotation until lever 22 has been pivoted the short clearance distance into engagement with boss 61. It is further noted that as a consequence of the one way clutch connection between sleeve 69 and shaft 70, the clockwise rotation of the sleeve does not drive roller 12.

FIG. 9 illustrates a position wherein shaft 16 has been driven through half a revolution and lever 22 has been pivoted to its extreme clockwise position. It is seen that sealing member 10 has been moved into contact with pad 41, while cutting member 11 has been moved into contact with plug 60, both members thereby having engaged the packaging material at different locations. The initial engagement of the heated sealer 32 with the leading portion of the packaging material disposed on pad 41 effects a welding seal between the opposite webs 93 and 94 to form the closed bottom portion of an individual bag, which is generally designated by the numeral 100 in FIG. 4. At the same time, severing blade 34 cuts laterally through the packaging material at a location slightly below the seal. On the back side of the machine, the simultaneous engagement of cutting blade 51 with a trailing portion of the packaging material effects a cut through the web 93 and both folds 91 and 92 to permit the formation of a three sided opening in the top of the bag member. Due to the slotted nature of blade 51, the cut effected thereby is in the form of a perforated line which assures that web 93 will not become tangled in the roller mechanism as the packaging material is advanced, although the perforated line is weak enough that it can be easily severed completely when it is desired to open the top of the bag.

It is seen that additional counterclockwise rotation of shaft 16 from the FIG. 9 position draws the eccentrically pinned lever 18 downwardly and thereby begins to rotate shaft 21 and the connected lever 22 in a counterclockwise direction. The counterclockwise pivoting of lever 22 immediately pulls both sealing member 10 and cutting member 11 away from the packaging material. However, counterclockwise rotation of wheel 23 does not begin immediately because the lever 22 must pivot a short distance before it engages boss 62 to begin to drive the wheel 23. As a consequence of the lost motion connection between lever 22 and wheel 23, the sealing member and the cutting member are withdrawn from engagement with the packaging material before wheel 23 begins to drive roller 12 by means of chain 66 and the clutch mechanism.

As shaft 16 continues its counterclockwise rotation after having moved lever 22 into engagement with boss 62, the chain 66, sprocket 68, and sleeve 69 combine to rotate shaft 70 and the connected roller 12 in a counterclockwise direction. The pressure between roller 12 and the idler roller 73 causes the packaging material threaded therebetween to be frictionally engaged by the two rollers and advanced a preselected distance, the advancement of the material terminating when motor M is deenergized. When the output shaft 16 has been driven a full revolution, the lower end of lever 18 depresses the cutoff switch S: to deenergize motor M and halt the rotation of shaft 16.

When the advancement of the packaging material has been completed, the closed bottom portion of the individual bag member 100 is supported on the bottom of tray 86. Web 93 is pulled outwardly to completely break the perforated line which was previously formed by cutting blade 51. The full capacity of bag 100 is presented at the open top portion thereof as webs 93 and 94 are separated and portions 91 and 92 are unfolded. The operation of fan 80 blows air downwardly from outlet 83 into the open top portion of bag 100 to retain the bag in its fully open condition. As bag 100 is then filled with objects, the weight of the objects acts on the hinged lever member 87 to depress fan switch 89 and thereby deenergize the fan motor.

When the bag has been filled, the operator may grasp the packaging material below the top portion to refold the portions 91 and 92 inwardly and hold the top of the bag upon pad 41. As foot pedal S is then depressed to begin a second power cycle and sealing member 10 thereby pivots toward pad 41 for the second time, the heated sealer 31 engages the packaging material slightly below the top of the filled bag 100 and effects a welding seal 101 between the opposite web to seal the top of the bag. Also, the optional toothed perforator 33 (if included on member 10) effects a row of punctures parallel to and slightly below seal 101 to create a weakened perforation line 102 which facilitates the eventual opening of the sealed bag member. As previously described, the simultaneous action of sealer 32 seals the bottom portion of the next succeeding bag member, while severing blade 34 completely severs the packaging material between the top of one bag and the bottom of the next bag, and cutting blade 51 forms a perforated line (which subsequently defines the open top of the next bag) on the back side of the machine at a trailing position on the packaging material. Again, the last part of the cycle advances the bottom of the next bag into tray 86 with its open top in a convenient position for receiving objects. By the intermittent depression of pedal switch S, successive bags may be formed, advanced into tray 86, filled with objects by the operator, sealed and perforated at the top, and removed from tray 86 as the next succeeding bag is immediately and automatically advanced thereinto.

From the foregoing it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described our invention, we claim:

1. Apparatus for packaging objects in bags successively formed from a supply of flexible tubular packaging material having opposing interconnecting panels, said apparatus comprising:

an upright frame;

guide means associated with said frame for receiving and supporting said packaging material;

a first sealing member supported on said frame to intermittently engage said packaging material and to effect a first seal between said opposing panels whereby said first seal forms a sealed bottom for a bag;

a cutting member supported on said frame to effect a cut substantially through one panel of said packaging material to form an open top portion of the bag at a location longitudinally offset along said packaging material from said first seal whereby objects can be received in said bag through the open top portion;

support means positioned to underlie the bag to support same thereon in a stationary position with the open top portion of the bag disposed to receive objects;

a second sealing member supported on said frame to effect a second seal between the opposing panels closely adjacent the top portion of the bag while the bag is maintained in its stationary position on said support means, whereby said bag can be sealed after receiving objects therein;

severing means supported on said frame to sever both panels of said packaging material above said second seal to separate the bag from the supply of packaging material while the bag is maintained in its stationary position on said support means; and drive means to actuate said first and second sealing members, said cutting member, and said severing means.

2. Apparatus as set forth in claim 1, including means for intermittently advancing said packaging material a preselected longitudinal distance.

3. Apparatus as set forth in claim 2, including linkage drivingly coupling said drive means to said advance means to intermittently actuate the latter, said linkage including a lost motion coupling to permit disengagement of said sealing and cutting members from said packaging material prior to the advancement of said packaging material.

4. Apparatus as set forth in claim 1, including blower means for retaining the top portion of the bag open to facilitate the insertion of objects therein.

5. Apparatus as set forth in claim 1, including means for supplying heat to said first and second sealing members.

6. Apparatus as set forth in claim 1, including a plug located between one panel of said packaging material and said cutting member to prevent said cutting member from engaging one of said panels.

7. Apparatus as set forth in claim 1, including a perforating member supported on said frame and intermittently activated by said drive means to form a perforation line on the bag closely adjacent said second seal.

8. Apparatus as set forth in claim 1, wherein said packaging material includes respective pairs of folded gussets interconnecting said opposing panels at the opposite lateral edges thereof, said cutting member effecting a cut substantially through said gussets to permit enlargement of the open top portion of the bag.

9. Apparatus as set forth in claim 8, including a plug located between one panel of said packaging material and said cutting member, and a pair of laterally spaced guide fingers operatively located to be received between the respective pairs of gussets to retain said gussets in a position accessible to said cutting member.

* * * * *